US006719671B1

(12) United States Patent
Böck

(10) Patent No.: US 6,719,671 B1
(45) Date of Patent: Apr. 13, 2004

(54) DEVICE FOR HELPING A PERSON TO WALK

(76) Inventor: Alexander Böck, Clauertstrasse 27, D-15806 Zossen (DE)

( * ) Notice: Subject to any disclaimer, the term of this patent is extended or adjusted under 35 U.S.C. 154(b) by 54 days.

(21) Appl. No.: 10/018,777

(22) PCT Filed: Jul. 19, 2000

(86) PCT No.: PCT/EP00/06897

§ 371 (c)(1),
(2), (4) Date: Dec. 21, 2001

(87) PCT Pub. No.: WO01/05469

PCT Pub. Date: Jan. 25, 2001

(30) Foreign Application Priority Data

Jul. 20, 1999 (DE) ..... 199 34 014

(51) Int. Cl.[7] ..... A63B 25/00
(52) U.S. Cl. ..... 482/75; 482/75; 482/76
(58) Field of Search ..... 482/75, 76, 77, 482/79, 74, 148; 623/28, 27, 32; 135/65, 68, 67

(56) References Cited

U.S. PATENT DOCUMENTS 1,597,792 A * 8/1926 Hoff et al.
1,613,533 A * 1/1927 Root
1,638,350 A * 8/1927 Long
2,172,000 A * 9/1939 Wenker
2,345,085 A * 3/1944 Albert et al.
3,444,631 A 5/1969 MacLeod

FOREIGN PATENT DOCUMENTS

| | | |
|---|---|---|
| DE | 27 01 894 | 7/1978 |
| DE | 199 15 813 | 7/2000 |
| FR | 2 783 175 | 3/2000 |

* cited by examiner

*Primary Examiner*—Jerome W. Donnelly
(74) *Attorney, Agent, or Firm*—Burns, Doane, Swecker & Mathis, L.L.P.

(57) ABSTRACT

What is described here is a device for facilitating the locomotion of a person by himself or herself by means of a spring system for removable attachment to both legs of the person, which spring system enables the person, by compression and deflection of at least one spring element, to walk on the ground by jumping step by step. The invention is distinguished by the provisions that the spring element is a leaf spring having an arc-shaped configuration, on the concave side of which a leverage mechanism is provided that is fixedly connected for rotation to the leaf spring via two separate fixing means and a base plate on which the respective foot of the person may be placed and which is connected, on the one hand, via at least one rotary pin bearing and one connecting rod to the first fixing means and, on the other hand, to the other fixing means either directly or via a central support rigidly connected to the base plate.

14 Claims, 5 Drawing Sheets

DEVICE FOR HELPING A PERSON TO WALK

FIELD OF THE INVENTION

The invention relates to a device for facilitating the locomotion of a person by himself or herself by means of a respective spring system removably fixed on both legs of the person, which spring system enables the person, by compression and deflection of at least one spring element, to walk on the ground by jumping step by step.

BACKGROUND OF THE INVENTION

Jumping and bouncing devices have been known for a long time and are distinguished by the most different spring systems. None of the known systems, however, permits locomotion by leaps similar to those performed on a trampoline. The reason must be seen to reside in the fact that so far no spring system has been found which is able to accumulate the required energy and has, at the same time, a dead weight so low that it does not give rise to occurrence of an impediment in the movements of the runner.

SUMMARY OF THE INVENTION

The present invention is based on the problem of providing a device for facilitated locomotion of person by means as simple and as easy to handle as possible, which enable the respective person to perform both high and wide jumps in a stable and safe manner without the interference of energy from the outside. The device is predominantly intended as toy or sports equipment and envisaged to serve for physical exercise. On the other hand, it should also be possible to use the device as means of locomotion, on account of its safe applicability, wherever the device can be expediently used for everyday practice.

The solution to the problem supporting the invention is defined in Claim 1. Features providing for expedient improvements of the inventive idea are the subject matters of the dependent claims.

In accordance with the present invention a device for facilitating the locomotion of a person by himself or herself by means of a spring system for removable attachment to both legs of the person, which spring system enables the person, by compression and deflection of at least one spring element, to walk on the ground by jumping step by step, is so configured that the spring element is a leaf spring having an arc-shaped configuration, on the concave side of which a leverage mechanism is provided that is fixedly connected for rotation to the leaf spring via two separate fixing means and a base plate on which the respective foot of the person may be placed and which is connected, on the one hand, via at least one rotary pin bearing and one connecting rod to the first fixing means and, on the other hand, to the other fixing means either directly or via a central support rigidly connected to the base plate.

The invention is based on the idea of utilising the resilience of a leaf spring to the effect that the resilient energy of the leaf spring is converted into jumping energy by selective deformation of the spring. To this end, a specifically shaped leaf spring is so attached on the runner's respective leg that a spring excursion of the leaf spring by more than 30 cm is achieved. Via a structure fastened on the runner's leg and preferably on the runner's knee, the so-called leverage mechanism, the runner's stepping force is transmitted to the leaf spring. During the stepping action the leaf spring undergoes an elastic deformation while energy is accumulated in the spring. The accumulated energy is released again in the rebound travel and thus enables the runner to move with a running style similar to the style common on a trampoline. For achievement of a straight rebound travel in spring deflection and in the rebound travel the leverage mechanism is equipped with an appropriate connecting brace that connects the base plate, on which the person's foot is positioned, to the leaf spring.

The leaf spring is preferably made of a glass fibre reinforced synthetic material and fastened by one of its ends—specifically the upper end in the condition of fixation on the runner's leg—via a fixing means configured as rotary pin bearing, preferably to the central support on which also a knee strap is provided that encloses the runner's knee in a flush manner. The runner's foot is fixedly positioned on the base plate that is fixedly connected to the central support at an angle of 90°.

It is also conceivable, however, that the base plate is connected directly to the upper end of the leaf spring via the fastening means. In this case, however, a solid shoe must be provided to ensure a safe fitting of the runner's foot, comparable to the fitting in a ski boot that may be detachably fixed to the base plate in the manner of a ski binding mechanism.

On the other end of the leaf spring some kind of sole is fixed that establishes the contact with the ground. A so-called connecting brace connects the leaf spring—approximately at one quarter of its length from the bottom—via a bearing to the base plate on the runner's foot.

With an appropriate harmonisation of the inter-axial spacings of all points of articulation between the leverage mechanism and the leaf spring as well as the development of rigidity along the contour of the leaf spring, the inventive configuration achieves a deformation of the leaf spring almost in parallel with the direction of the runner's stepping force as well as a straight deformation. The point where the force is introduced between the ground and the spring device is shifted backward, i.e. in a direction towards the runner's heel, by rolling the sole along the ground, in proportion to the deflection of the spring. This is desirable because this corresponds to the normal shift of forces in the foot under a load.

A force created by the runner is transmitted along two paths onto the leaf spring and then to the ground: one path leads via the leverage mechanism and the upper fastening means to the spring and from the latter via the sole to the ground. A second path leads via the connecting brace and its journal bearing up to the lower quarter of the leaf spring and from there equally via the sole to the ground.

BRIEF DESCRIPTION OF THE DRAWINGS

The invention will be described by the following exemplary embodiments, without any restriction of the general inventive idea, with reference to the drawing wherein.

DETAILED DESCRIPTION OF THE INVENTION

Figure 1A:
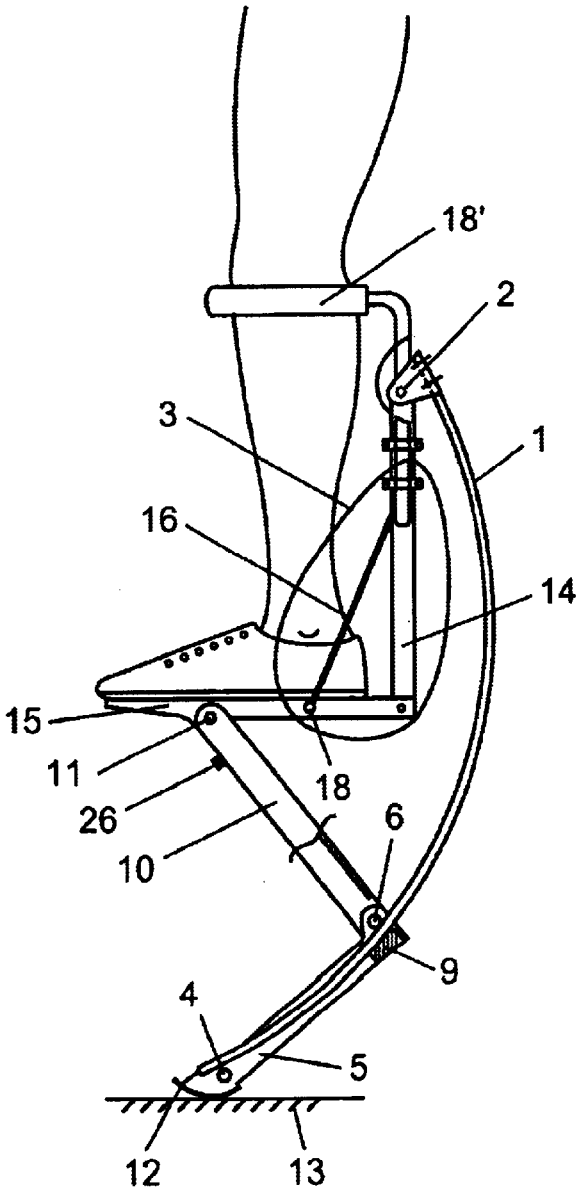
FIG. 1A shows a jumping device in the unbiased state.
Figure 1B:
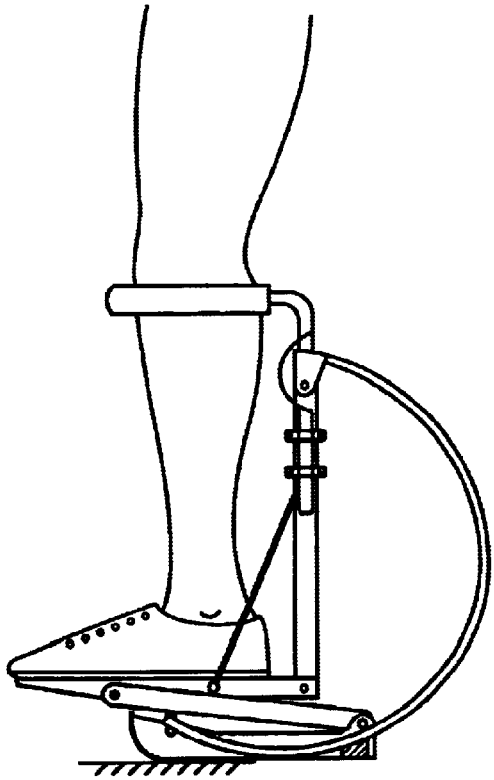
FIG. 1B shows a jumping device in the deformed state.

FIG. 1*a* shows an inventive jumping device in the unbiased condition while FIG. 1*b* illustrates it in the deformed state. A spring 1 of circular configuration, which is made of glass fibre reinforced synthetic material, is connected by its upper end via a journal bearing 2 to a structure 3 mounted on the foot and the knee of a runner. The structure 3 consists of a base plate 15, on which the runner's foot may be positioned, as well as a central support 14 that is fixed to the base plate 15 at a right angle and is equipped in the upper section with a knee strap 18'.

Figure 2A:
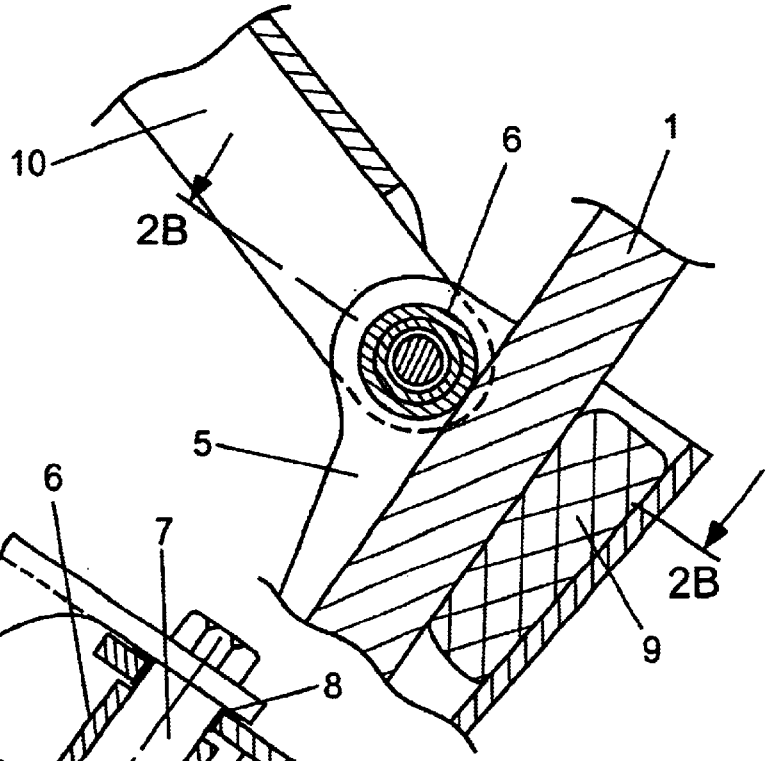
FIG. 2A is a longitudinal section taken through the connection between the connecting brace and a pedal.
Figure 2B:
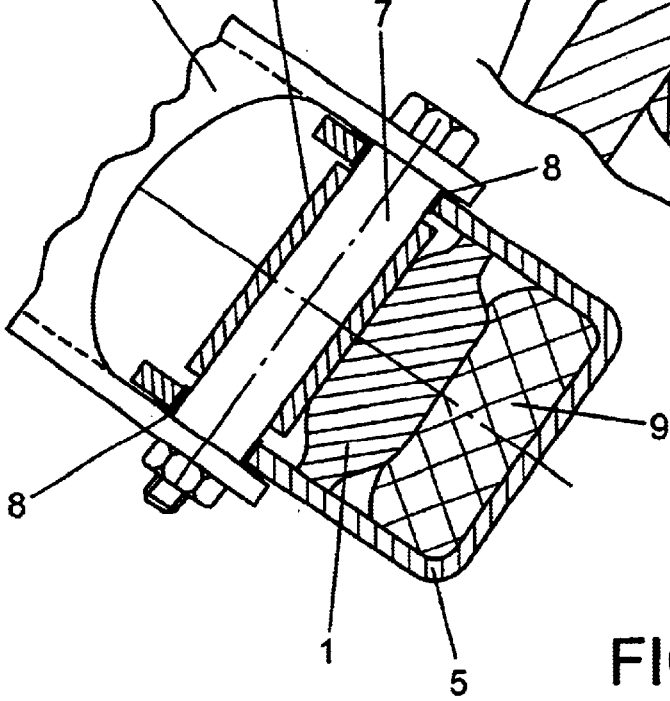
FIG. 2B is a cross-section taken along the line 2B—2B shown in FIG. 2A.

At the lower end, the spring 1 is fastened via a further journal bearing 4 to the pedal 5. The pedal 5 is connected via a roller 6, whose axle 7 is positioned via bearings 8 in the pedal 5, and an opposite elastic plate 9 to the spring 1 in a manner preventing relative rotation (cf. detailed views in FIG. 2 where (a) is a longitudinal section and (b) is a cross-section taken through the foot zone of the device). The connecting brace 10 connects the axle 7 via the bearing 11 to the structure 3 or the base plate 15, respectively, on the runner's foot.

Figure 3B:
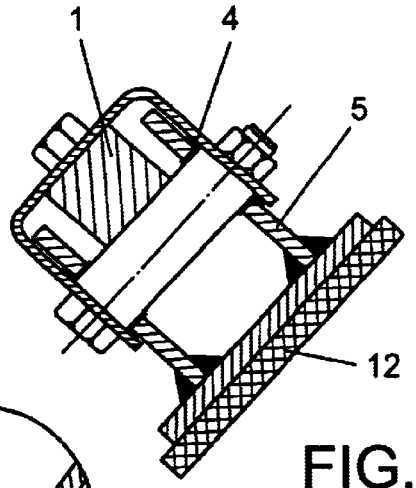
FIG. 3B is a cross-section taken along the line 3B—3B shown in FIG. 3A.
Figure 3A:
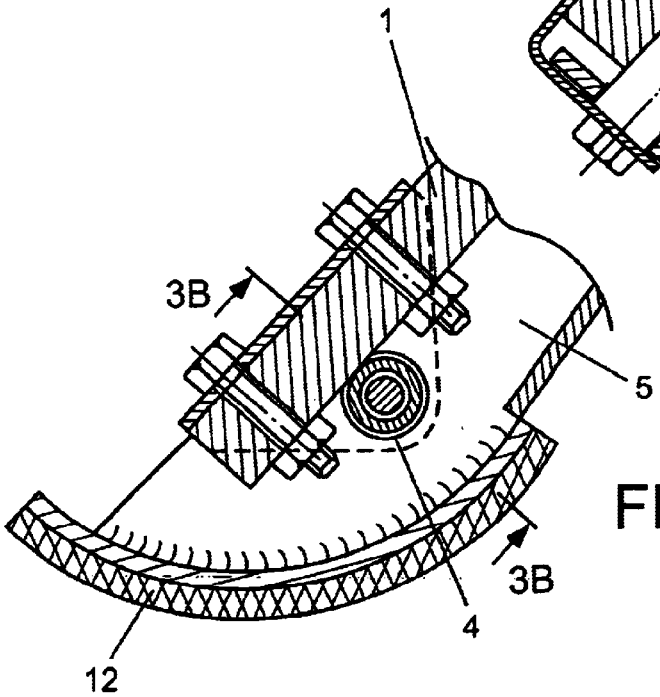
FIG. 3A is a longitudinal section taken through the pedal.

Moreover, a cylindrical sole 12 is provided on the pedal 5, whose cylinder axis does not necessarily coincide with the axis of the bearing 4. The sole 12 constitutes the surface of contact with the ground 13 (cf. also detail view according to FIGS. 3*a, b*).

A rubber buffer 26 is provided on the connecting brace 10 as end stop in the case of complete spring deflection. In this manner the spring deflection is terminated by a defined point so that damage cannot occur on the mechanical system.

Figure 4:
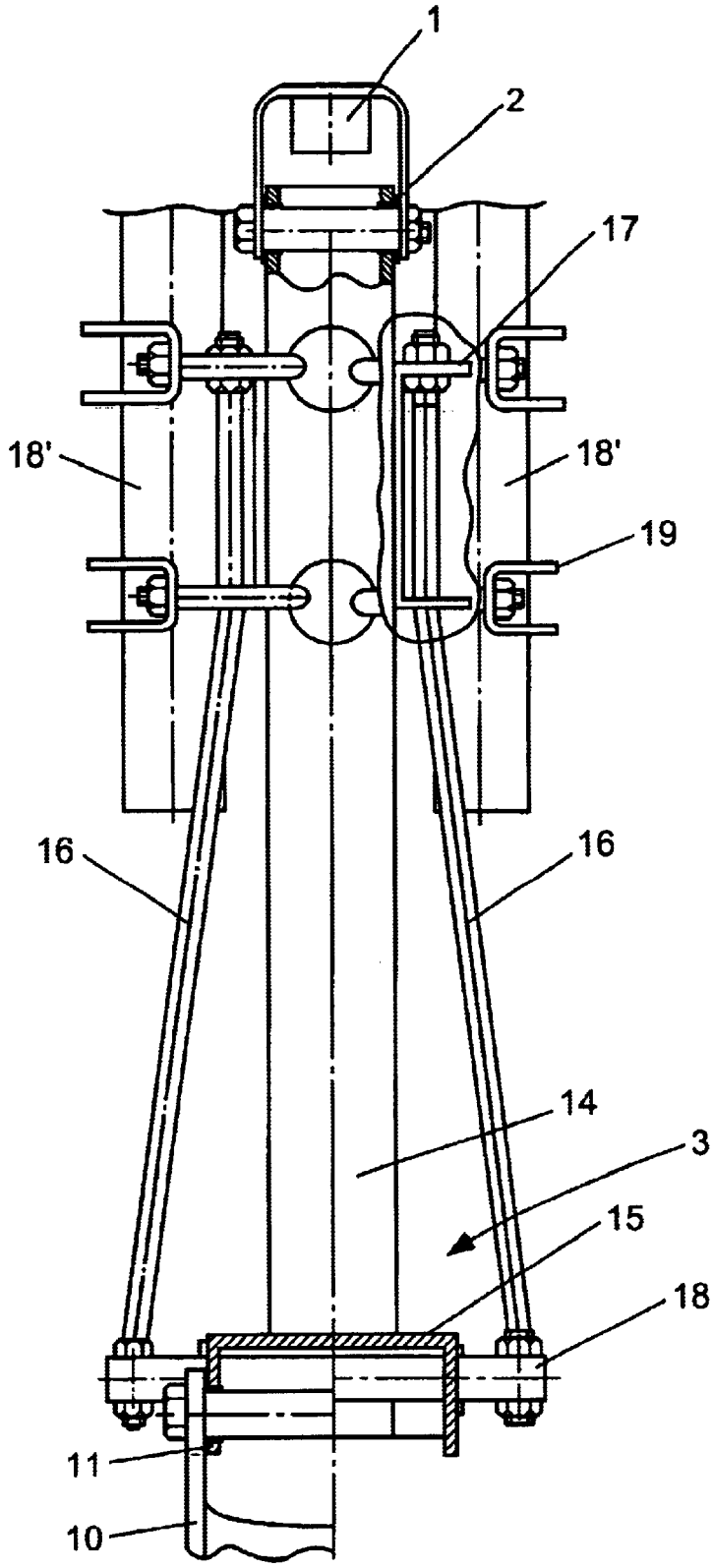
FIG. 4 shows the central support with articulations.

According to FIG. 4, the structure 3 comprises a central support 14 that is screwed to the base plate 15. Two spokes 16 connect the central support 14 to the base plate 15 via a riveting plate 17 and a transverse bolt 18. The runner's shoe is mounted on the base plate 15 by screwing, for example. A knee strap 18' is screwed to the structure 3 via pipe clamps 19.

A force exerted by the runner is now transmitted onto the spring 1 and then to the ground 13 along two paths. One path leads via the structure 3 and the upper support 2 to the spring 1 and from there via the lower support 4, the pedal 5 and the sole 12 to the ground 13 (cf. FIG. 1*a*).

A second path leads via the connecting brace 10 to the axle 7 with the roller 6 onto the spring 1. From there it passes via the pedal 5 and the spring 1 to the ground 13.

The roller 6 (FIGS. 2*a, b*) serves two functions in this concept. On the one hand, it transmits part of the force from the connecting brace 10 to the spring 1, on the other hand it permits a relative movement of the spring 1 to the roller axle 7 that is fixed at the bottom via bearings 4 in the pedal 5, as has been described above. The relative movement occurs as a consequence of bending and the resulting variation of the arc length of the spring 1 in the zone between the bearing 4 and the axle 7.

Figure 5:
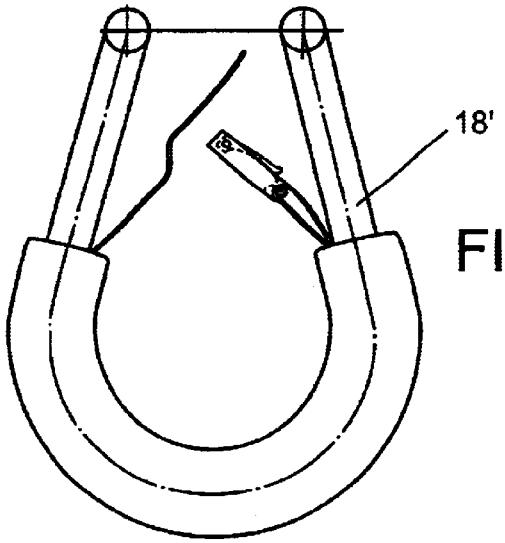
FIG. 5 is a view of the knee strap.

The flexural strength of the device in a direction across the running direction must be as high as possible so that the balance can be maintained in running. This flexural strength is mainly determined by the rigidity of the structure 3 and the connecting brace 10 with the bearing 11, which is connected with the structure (FIG. 4). The contribution of the spring 1 to this effect is negligible. To achieve this high flexural strength in the transverse direction the central support 14 is therefore configured as closed rectangular section so that it will be able to transmit torsional forces. The spokes 16 serve equally not only to transmit the spring forces but also rigidify the structure against torsion of the base plate 15. The width of the control lever 10 and the resulting long stance of the bearing shells of the bearing 11 constitute a further contribution to the rigidity. With the bending forces occurring as a result of pressure of the runner's knee in the transverse direction, the knee strap 18' must equally present an appropriate rigidity and must be rigidly connected to the structure 3. To this end, it is screwed by means of the pipe clamps 19 to the structure 3 at four locations. A preferred embodiment of the knee strap 18' is illustrated in FIG. 5.

Figure 6:
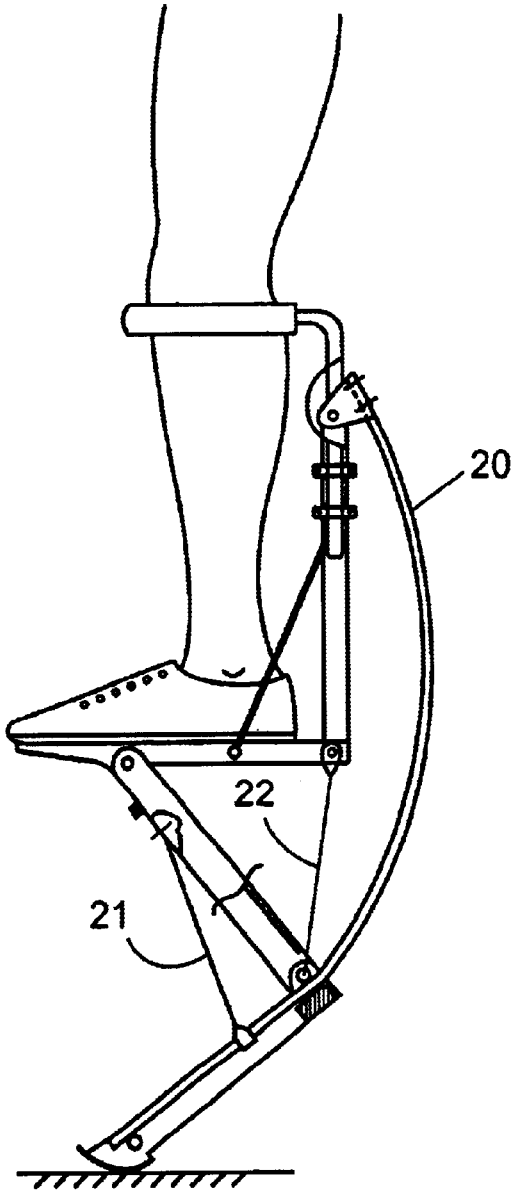
FIG. 6 shows one embodiment.
Figure 7:
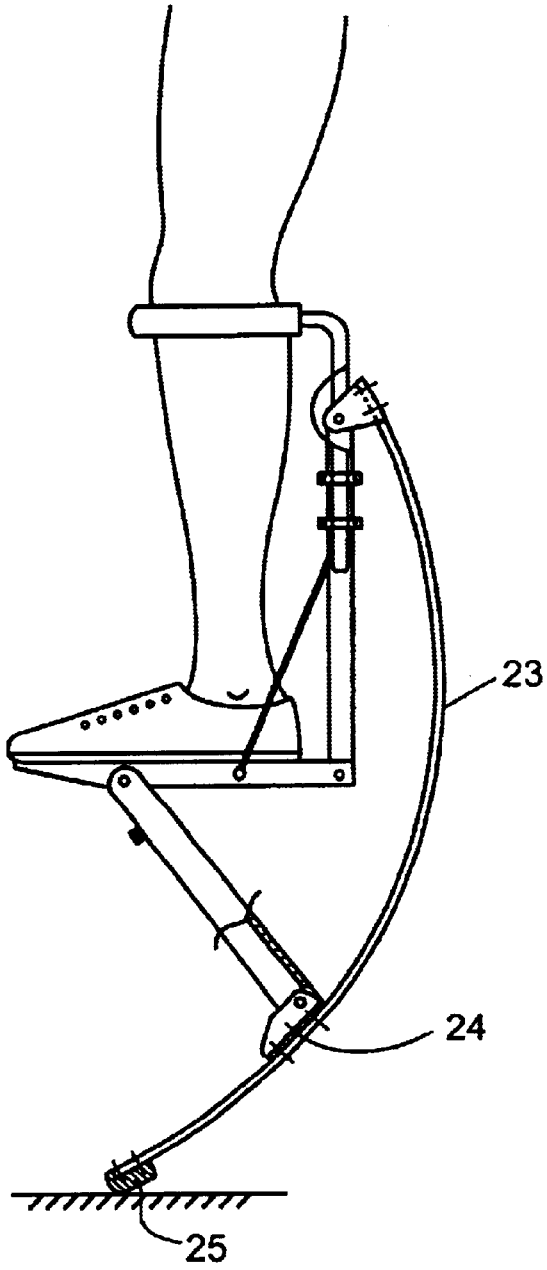
FIG. 7 shows one embodiment.

FIGS. 6 and 7 illustrate two variants of the jumping device. The variant in FIG. 6 is characterised by the aspect that a plane leaf spring 20 is biased via a rope 21 or a rope 22. With this provision a substantial reduction of the manufacturing costs of the leaf spring 20 can be achieved. The bias takes, however, a negative influence on the spring characteristic and on the straightness of the spring deflection path.

The variant shown in FIG. 7 is characterised by a supporting base 24 screwed to the leaf spring 23. There, the sole 25 is fastened on the spring 23 directly. This provision permits the achievement of a substantial reduction of the weight of the sole, which increases the comfortableness in running. Here, however, the fixation of the supporting base 24 on the leaf spring is the crucial point.

List of reference numerals

1 leaf spring
2 connecting means
3 structure
4 journal bearing
5 pedal
6 roller
7 axle
8 journal bearing
9 elastic plate
10 connecting brace
11 bearing
12 sole
13 bottom
14 central support
15 base plate
16 spoke
17 riveting plate
18 transverse bolt
18' knee strap
19 pipe clamp
20 spring leaf
21 rope
22 rope
23 leaf spring
24 support base
25 sole

What is claimed is:

1. Device for facilitating the locomotion of a person comprising:

a spring system removably attachable to a leg of the person, the spring system including at least one spring element, the spring system enabling the person, by compression and deflection of the at least one spring element, to walk on a ground surface by jumping step-by-step, said at least one spring element comprising a leaf spring having an arc-shaped configuration;

a leverage mechanism provided on a concave side of the leaf spring, the leverage mechanism being connected to the leaf spring by first and second fixing connections and a base plate onto which a foot of the person may be placed, wherein the base plate is connected by at least one rotary pin bearing and one connecting rod to the first fixing connection and to the second fixing connection by at least one of a direct connection and a central support rigidly connected to the base plate;

wherein said connecting rod is connected to a pedal via a further rotary pin bearing that co-operates with said pedal to enclose said spring element, and said connecting rod is supported for sliding relative to said further rotary pin bearing, and said pedal is fixedly connected for rotation or fixed to said connecting rod in a terminal zone of said spring element.

2. Device according to claim 1, wherein said pedal presents a cylindrically shaped contour in the terminal zone of said spring element or is fixedly connected to a cylindrical or spherically configured sole element for detachment.

3. A device for facilitating the locomotion of a person by himself or herself, said device comprising:

a spring system for removable attachment to a leg of the person, said spring system including at least one spring element having a first spring end and a second spring end, said at least one spring element defining an arc-shaped configuration between said first and second spring ends;

a pivotal connecting mechanism including a first end and a second end, a first end of said connecting mechanism being fixedly connected to said at least one spring element proximal said first spring end by a first fastening device;

a leverage mechanism fixedly connected to said at least one spring element proximal said second spring end by a second fastening device, said leverage mechanism including a base plate positioned for supporting a foot of the person;

wherein said second end of said connecting mechanism is pivotally connected to said leverage mechanism whereby said spring system enables the person, by compression and deflection of said at least one spring element, to walk on a ground surface by jumping step by step.

4. The device according to claim 3, wherein said at least one spring element is a leaf spring.

5. The device according to claim 3, wherein said leverage mechanism further includes a central support, said base plate being rigidly connected to said central support, said central support being operatively connected to said second fastening device mounted on said second end of said at least one spring element.

6. The device according to claim 5, wherein said base plate is connected at a right angle to said central support.

7. The device according to claim 5, further comprising connecting spokes extending from said base plate to said central support, said connecting spokes being connected to said base plate rearward of the connection of said second end of said connecting mechanism to said leverage mechanism.

8. The device according to claim 3, wherein said connecting mechanism includes a connecting brace and a pedal hingedly connected together through an axle.

9. The device according to claim 8, wherein said at least one spring element is disposed between said pedal and said connecting brace.

10. The device according to claim 8, wherein said pedal includes a cylindrically shaped contour proximal said first spring end of said at least one spring element for contacting a ground surface.

11. The device according to claim 8, wherein said pedal is detachably connected to a cylindrical or spherical shaped sole element for contacting a ground surface.

12. The device according to claim 3, wherein said leverage mechanism further comprises a knee strap for holding the persons's leg, said knee strap being disposed proximal said second fastening device.

13. A device for facilitating the locomotion of a person by himself or herself, said device comprising:

a spring system for removable attachment to a leg of the person;

said spring system including at least one spring element having a first spring end and a second spring end, said at least one spring element defining an arc-shaped configuration between said first and second spring ends;

a pivotal connecting mechanism including a first end and a second end, a first end of said connecting mechanism being fixedly connected to said at least one spring element proximal said first spring end by a first fastening device, said connecting mechanism including a connecting brace and a pedal hingedly connected together through an axle;

a leverage mechanism fixedly connected to said at least one spring element proximal said second spring end by a second fastening device, said leverage mechanism including a base plate positioned for supporting a foot of the person and a central support, said base plate being rigidly connected to said central support;

wherein said central support is operatively connected to said second fastening device mounted on said second end of said at least one spring element;

wherein said second end of said connecting mechanism is pivotally connected to said base plate;

wherein said pedal includes a cylindrically shaped contour proximal said first spring end of said at least one spring element for contacting a ground surface; and wherein said at least one spring element extends between said pedal and said connecting brace whereby said spring system enables the person, by compression and deflection of said at least one spring element, to walk on a ground surface by jumping.

14. The device according to claim 13, wherein said leverage mechanism further comprises a knee strap for holding the persons's leg, said knee strap being disposed proximal said second fastening device.

* * * * *